US007540809B2

(12) United States Patent
Costain

(10) Patent No.: US 7,540,809 B2
(45) Date of Patent: Jun. 2, 2009

(54) CUE STICK JOINT

(76) Inventor: Paul D. Costain, 2 Spruce Run, Beverly, MA (US) 01915

( * ) Notice: Subject to any disclaimer, the term of this patent is extended or adjusted under 35 U.S.C. 154(b) by 0 days.

(21) Appl. No.: 11/409,509

(22) Filed: Apr. 21, 2006

(65) Prior Publication Data

US 2007/0249427 A1 Oct. 25, 2007

(51) Int. Cl.
*A63D 15/08* (2006.01)

(52) U.S. Cl. ..... 473/44; 473/296; 403/296; 403/306

(58) Field of Classification Search ..... 473/44–51, 473/288, 306, 307, 310, 296, 239, 552, 564–568, 473/560, 457; 403/296, 297, 306, 307, 314, 403/292

See application file for complete search history.

(56) References Cited

U.S. PATENT DOCUMENTS

| | | | |
|---|---|---|---|
| 122,218 | A | 12/1871 | Bogart |
| 248,681 | A | 10/1881 | Walter |
| 664,528 | A | 12/1900 | Brauers |
| 682,677 | A | 9/1901 | Ferchland |
| 812,309 | A | 2/1906 | Swagerty |
| 965,131 | A | 7/1910 | Bliss |
| 970,172 | A | 9/1910 | Bloom et al. |
| 1,147,705 | A | 7/1915 | Campbell |
| 1,527,748 | A | 2/1925 | Rambow |
| 1,527,853 | A | 2/1925 | Ferdon |
| 1,609,026 | A | 11/1926 | Lindley |
| 1,679,073 | A | 7/1928 | Carmichael |
| 1,705,353 | A | 3/1929 | Barrett |
| 2,227,735 | A | 1/1941 | Morton |
| 3,170,691 | A | 2/1965 | Pritchard |

(Continued)

FOREIGN PATENT DOCUMENTS

| | | |
|---|---|---|
| CA | 726578 | 1/1966 |

(Continued)

OTHER PUBLICATIONS

Drawing of coupling rod manufactured by Bender Cues for securing to one stick portion of a cue stick (Jul. 13, 1992).

(Continued)

*Primary Examiner*—Mark S Graham
(74) *Attorney, Agent, or Firm*—Hamilton, Brook, Smith & Reynolds, P.C.

(57) ABSTRACT

A joint for a cue stick where the cue stick has first and second cue stick portions. The joint can include a first joint member for securing to the first stick portion. The first joint member can have a joint securing male threaded region and a locating tip at a distal end. A second joint member can be included for securing to the second stick portion. The second joint member can have a bore for receiving the locating tip, and a joint securing female threaded region for engaging the joint securing male threaded region of the first joint member for coupling the first and second joint members together. The locating tip can have a pivot structure that is configured to engage the bore and pivot against the bore such that the first joint member is capable of pivoting about the pivot structure to compensate for misalignment of the first and second joint members.

19 Claims, 5 Drawing Sheets

U.S. PATENT DOCUMENTS

| | | | |
|---|---|---|---|
| 3,232,613 | A | 2/1966 | Laube, Jr. |
| 3,312,139 | A | 4/1967 | DiCristina |
| 3,334,901 | A | 8/1967 | Steffes |
| 3,368,271 | A | 2/1968 | Sheffler |
| 3,436,079 | A | 4/1969 | Berry et al. |
| 3,462,147 | A | 8/1969 | Mancuso |
| 3,848,737 | A | 11/1974 | Kenon |
| 4,231,574 | A | 11/1980 | Williams |
| 4,314,575 | A | 2/1982 | Kuo |
| 4,340,227 | A | 7/1982 | Dopkowski |
| 4,440,391 | A | 4/1984 | Saenz, Jr. |
| 4,565,392 | A | 1/1986 | Vyse |
| 4,577,990 | A | 3/1986 | Carlson |
| 4,630,958 | A | 12/1986 | McCallister |
| 4,645,245 | A | 2/1987 | Cunningham |
| 4,718,671 | A | 1/1988 | Desmond et al. |
| 4,797,021 | A | 1/1989 | Stamper |
| 4,858,926 | A | 8/1989 | Cabianca |
| 4,943,333 | A | 7/1990 | Chang |
| 5,062,636 | A | 11/1991 | Rahn |
| 5,112,046 | A | 5/1992 | Thorpe |
| 5,193,929 | A | 3/1993 | Kahn |
| 5,290,030 | A | 3/1994 | Medbury |
| 5,334,101 | A | 8/1994 | McDermott |
| 5,407,197 | A | 4/1995 | Parsons |
| 5,514,039 | A | 5/1996 | Gendron et al. |
| 5,518,455 | A | 5/1996 | Costain et al. |
| 5,527,224 | A | 6/1996 | Costain et al. |
| 5,643,095 | A | 7/1997 | Probst |
| 5,678,944 | A | 10/1997 | Slocum et al. |
| 5,820,473 | A | 10/1998 | Lambros |
| 5,857,923 | A | 1/1999 | Veller |
| 5,890,966 | A | 4/1999 | Costain et al. |
| 5,927,894 | A | 7/1999 | Zavaglia |
| 5,997,412 | A | 12/1999 | Benson |
| 6,027,410 | A | 2/2000 | Costain et al. |
| 6,050,903 | A | 4/2000 | Lake |
| 6,056,472 | A | 5/2000 | Latulippe et al. |
| 6,132,321 | A | 10/2000 | Wethered |
| 6,164,188 | A | 12/2000 | Miser |
| 6,165,078 | A | 12/2000 | Holt |
| 6,227,980 | B1 | 5/2001 | Costain et al. |
| 6,348,006 | B2 | 2/2002 | Costain et al. |
| 6,371,865 | B1 | 4/2002 | Magliulo |
| 6,398,660 | B1 | 6/2002 | Probst et al. |
| 6,447,404 | B1 | 9/2002 | Wilbur |
| 6,582,317 | B2 | 6/2003 | Pechauer et al. |
| 6,638,178 | B2 | 10/2003 | Tseng |
| 6,712,712 | B2 | 3/2004 | Bourque |
| 6,764,413 | B2 | 7/2004 | Ho |
| 6,783,462 | B1 | 8/2004 | Costain |
| 7,241,226 | B2 | 7/2007 | Costain et al. |
| 2001/0008854 | A1 | 7/2001 | Costain et al. |
| 2001/0051547 | A1 | 12/2001 | Takahira |
| 2003/0039508 | A1 | 2/2003 | Barbosa |
| 2003/0050129 | A1 | 3/2003 | Kuo |
| 2003/0166419 | A1 | 9/2003 | Gulyassy |
| 2003/0235461 | A1 | 12/2003 | Hsu |
| 2005/0043107 | A1 | 2/2005 | Kuo |
| 2007/0060406 | A1 | 3/2007 | Miki |

FOREIGN PATENT DOCUMENTS

| | | | |
|---|---|---|---|
| EP | 0 465 202 | A1 | 1/1992 |
| GB | 000008849 | A | 7/1885 |
| GB | 2 096 470 | A | 10/1982 |
| GB | 2 191 707 | A | 12/1987 |
| GB | 2 192 800 | A | 1/1988 |
| GB | 2 199 505 | A | 7/1988 |
| GB | 2 209 681 | A | 5/1989 |
| GB | 2 219 946 | A | 12/1989 |
| GB | 2 222 091 | A | 2/1990 |
| GB | 2 226 251 | A | 6/1990 |
| GB | 2 246 302 | A | 1/1992 |
| GB | 2 268 082 | A | 1/1994 |
| GB | 2 279 017 | A | 12/1994 |
| JP | 8-117388 | | 5/1996 |

OTHER PUBLICATIONS

Drawing of a prior art cue stick portion having a coupling rod and joint collar (at least by 1985).

Drawing depicting a coupling joint which engages in three revolutions. The smooth elongate tip extending from the external threaded region is not in a close fit with the bore extending from the internal threaded region upon engaging the two threaded regions.

Drawing depicting a coupling joint which has an external threaded region characterized by a significant number of threads. The internal threaded region is characterized by two threads. Extending from the internal threaded region is a smooth bore for receiving the external threaded region. The coupling joint engages in a significant number of revolutions.

CUE STICK JOINT

BACKGROUND

Cue sticks for playing pool can have two or more tapered stick portions which can be assembled together for use and disassembled for storage. Typically, the mating ends of the stick portions that become joined together include joint members which engage each other for securing the stick portions together. Manufacturers can have great difficulty accurately installing joint members in the stick portions. Current inspection techniques and equipment are typically insufficient for assuring proper positioning of the joint members in tapering stick portions. Concentricity and/or run out and perpendicularity are difficult dimensions to maintain with processes and procedures known in the art. Misalignment of the joint members in their respective stick portions can cause misalignment of the stick portions when assembled. Misalignment of the stick portions can adversely affect the performance of the cue stick during use.

SUMMARY

The present invention can provide a joint for a cue stick which can secure stick portions of a cue stick together in alignment with each other when there is misalignment of joint members in the stick portions. The joint can have adequate concentricity and can allow the faces of the stick portions to come together without requiring strict tolerances of perpendicularity of the joint members in the stick portions.

The present invention can provide a joint for a cue stick where the cue stick has at least first and second cue stick portions. The joint can include a first joint member for securing to the first stick portion. The first joint member can have a joint securing male threaded region and a locating tip at a distal end. A second joint member can be included for securing to the second stick portion. The second joint member can have a bore for receiving the locating tip, and a joint securing female threaded region for engaging the joint securing male threaded region of the first joint member for coupling the first and second joint members together. The locating tip can have a pivot structure that is configured to engage the bore and pivot against the bore such that the first joint member is capable of pivoting about the pivot structure to compensate for misalignment of the first and second joint members.

In particular embodiments, the pivot structure of the locating tip can have a close fit with the bore. The bore can have a constant diameter portion for receiving and engaging the pivot structure of the locating tip. The pivot structure can have a pivot surface that is shaped for pivoting within the constant diameter portion of the bore. The pivot structure can have a narrow annular region of engagement with the bore within the constant diameter portion. The locating tip can include a generally curved portion.

In one embodiment, the locating tip can include a generally spherical portion at the end. In another embodiment, the locating tip can include a generally bullet shaped portion. In yet another embodiment, the locating tip can include a generally rounded portion that extends from a constant diameter portion.

In other embodiments, the locating tip can include a generally tapered portion. In one embodiment, the generally tapered portion of the locating tip can include a flat end. In another embodiment, the generally tapered portion of the locating tip can include a pointed end. In a different embodiment, the locating tip can include a generally disc shaped portion.

The first and second joint members can be capable of engaging together within about four turns relative to each other. In some embodiments, the first and second joint members can be capable of engaging together within about one turn relative to each other. The first joint member can further include a collar encircling the male threaded region. The first and second joint members can include secondary male threaded regions for securing the first and second joint members to respective first and second stick portions. The first and second joint members can each include a smooth outer diameter region adjacent to the secondary male threaded region.

The present invention can also provide a cue stick including a first cue stick portion and a first joint member secured to the first stick portion. The first joint member can include a joint securing male threaded region and a locating tip at a distal end. The cue stick can include a second cue stick portion and a second joint member secured to the second stick portion. The second joint member can have a bore for receiving the locating tip, and a joint securing female threaded region for engaging the joint securing male threaded region of the first joint member for coupling the first and second joint members together. The locating tip can have a pivot structure that is configured to engage the bore and pivot against the bore such that the first joint member is capable of pivoting about the pivot structure to compensate for misalignment of the first and second joint members.

In particular embodiments, the first and second joint members can include features such as previously discussed above.

The present invention can also provide a joint for a sports stick, where the sports stick can have first and second sports stick portions. The joint can include a first joint member for securing to the first stick portion. The first joint member can include a joint securing male threaded region and a locating tip at a distal end. A second joint member can be included for securing to the second stick portion. The second joint member can have a bore for receiving the locating tip, and a joint securing female threaded region for engaging the joint securing male threaded region of the first joint member for coupling the first and second joint members together. The locating tip can have a pivot structure that is configured to engage the bore and pivot against the bore such that the first joint member is capable of pivoting about the pivot structure to compensate for misalignment of the first and second joint members.

In particular embodiments, the first and second joint members can include features such as previously described above.

The present invention can also provide a sports stick including a first sports stick portion and a first joint member secured to the first stick portion. The first joint member can include a joint securing male threaded region and a locating tip at a distal end. The sports stick can include a second sports stick portion and a second joint member secured to the second stick portion. The second joint member can have a bore for receiving the locating tip, and a joint securing female threaded region for engaging the joint securing male threaded region of the first joint member for coupling the first and second joint members together. The locating tip can have a pivot structure that is configured to engage the bore and pivot against the bore such that the first joint member is capable of pivoting about the pivot structure to compensate for misalignment of the first and second joint members.

In particular embodiments, the first and second joint members can include features such as previously described above.

The present invention can also provide a method of securing a joint for a cue stick, where the cue stick can have first and second cue stick portions. A first joint member can be provided for securing to the first stick portion. The first joint member can include a joint securing male threaded region and a locating tip at a distal end. A second joint member can be provided for securing to the second stick portion. The second joint member can have a bore and a joint securing female threaded region. The locating tip of the first joint member can be engaged with the bore of the second joint member. The joint securing male threaded region of the first joint member can be engaged with the joint securing female threaded region of the second joint member for coupling the first and second joint members together. A pivot structure of the locating tip can be engaged with the bore. The pivot structure can be configured for pivoting against the bore such that the first joint member is capable of pivoting about the pivot structure to compensate for misalignment of the first and second joint members.

In particular embodiments, the first and second joint members can include features such as previously described above.

The present invention can also provide a method of securing a cue stick together, where the cue stick can have first and second cue stick portions. A first joint member can be provided with the first stick portion. The first joint member can include a joint securing male threaded region and a locating tip at a distal end. A second joint member can be provided with the second stick portion. The second joint member can have a bore and a joint securing female threaded region. The locating tip of the first joint member can be engaged with the bore of the second joint member. The joint securing male threaded region of the first joint member can be engaged with the joint securing female threaded region of the second joint member for coupling the first and second joint members together. The pivot structure of the locating tip can be engaged with the bore. The pivot structure can be configured for pivoting against the bore such that the first joint member is capable of pivoting about the pivot structure to compensate for misalignment of the first and second joint members.

In particular embodiments, the first and second joint members can include features such as previously described above.

The present invention can also provide a method of securing a joint for a sports stick, where the sports stick can have first and second sports stick portions. A first joint member can be provided for securing to the first stick portion. The first joint member can include a joint securing male threaded region and a locating tip at a distal end. A second joint member can be provided for securing to the second stick portion. The second joint member can have a bore and a joint securing female threaded region. The locating tip of the first joint member can be engaged with the bore of the second joint member. The joint securing male threaded region of the first joint member can be engaged with the joint securing female threaded region of the second joint member for coupling and first and second joint members together. A pivot structure of the locating tip can be engaged with the bore. The pivot structure can be configured for pivoting against the bore such that the first joint member is capable of pivoting about the pivot structure to compensate for misalignment of the first and second joint members.

In particular embodiments, the first and second joint members can include features such as previously discussed above.

The present invention can also provide a method of securing a sports stick together, where the sports stick can have first and second sports stick portions. A first joint member can be provided with the first stick portion. The first joint member can include a joint securing male threaded region and a locating tip at a distal end. A second joint member can be provided with the second stick portion. The second joint member can have a bore and a joint securing female threaded region. The locating tip of the first joint member can be engaged with the bore of the second joint member. The joint securing male threaded region of the first joint member can be engaged with the joint securing female threaded region of the second joint member for coupling the first and second joint members together. A pivot structure of the locating tip can be engaged with the bore. The pivot structure can be configured for pivoting against the bore such that the first joint member is capable of pivoting about the pivot structure to compensate for misalignment of the first and second joint members.

In particular embodiments, the first and second joint members can include features such as previously discussed above.

BRIEF DESCRIPTION OF THE DRAWINGS

The foregoing will be apparent from the following more particular description of example embodiments of the invention, as illustrated in the accompanying drawings in which like reference characters refer to the same parts throughout the different views. The drawings are not necessarily to scale, emphasis instead being placed upon illustrating embodiments of the present invention.

DETAILED DESCRIPTION

Figure 2:
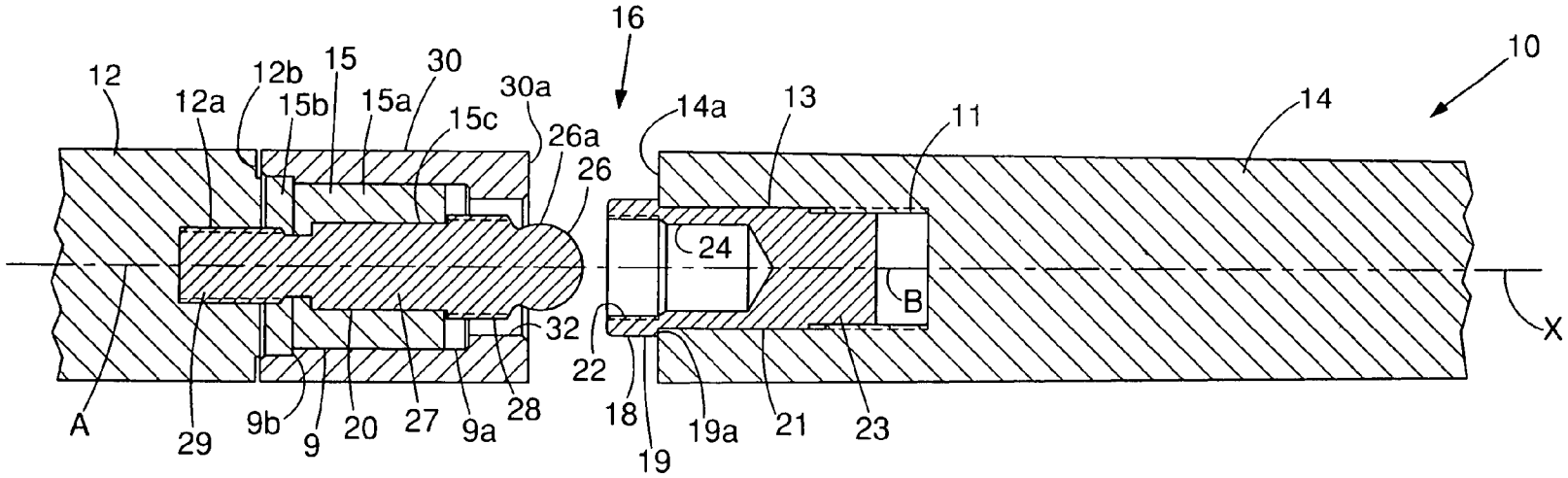
FIG. 2 is a sectional view of FIG. 1.
Figure 1:
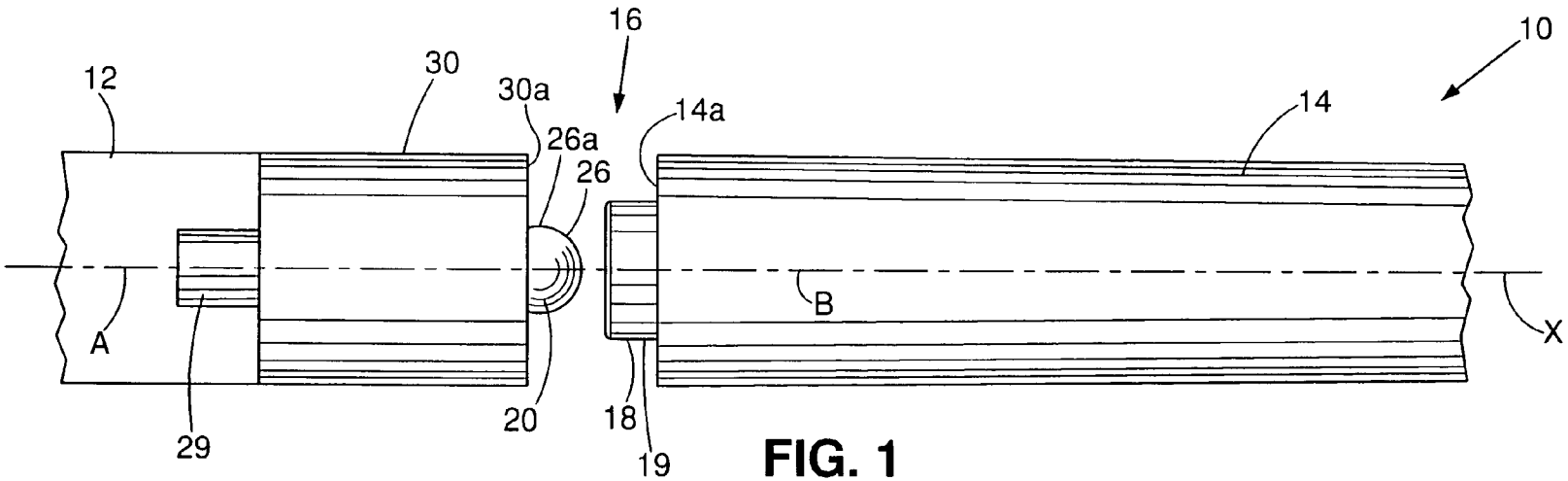
FIG. 1 is a side view of two stick portions incorporating an embodiment of a joint in the present invention.

FIGS. 1 and 2 depict two stick portions 12 and 14 of a sports stick, for example, a cue stick 10, which can be coupled together by a joint 16. The cue stick 10 can extend along a longitudinal axis X and include a first stick portion 12 that can form the butt, and a second stick portion 14 that can form the shaft or tip, or vice versa. A coupling rod, pin or first joint member 20 having a longitudinal axis A (FIG. 3), can be secured to the first stick portion 12, and an insert sleeve or second joint member 18 having a longitudinal axis B (FIG. 4), can be secured to the second stick portion 14. The coupling rod 20 can include a centering or locating pin or tip 26 at the distal end, and a joint securing male threaded portion or region 28. The coupling rod 20 can be secured within a hole 12*a* at the end of the stick portion 12 with a secondary male threaded portion or region 29. The locating tip 26 can include a pivot structure 26*a* having pivot surfaces. A generally cylindrical collar 30 can be positioned at the end 12*b* of stick portion 12 and encircle the male threaded region 28 for protecting the male threaded region 28. The collar 30 can be centered and positioned relative to the coupling rod 20 by a bushing 15 therebetween. The sleeve 18 can include a receiving cavity having a joint securing female threaded portion or region 22 and a bore 24. The sleeve 18 can be secured to stick portion 14 within a hole 13 by a secondary male threaded portion or region 23.

The male threaded region 28 of the coupling rod 20 can engage the female threaded region 22 of the sleeve 18 for securing stick portion 12 to stick portion 14. The locating tip 26 of the coupling rod 20 can closely engage the bore 24 for aligning the coupling rod 20 and stick portion 12 with the sleeve 18 and stick portion 14. The pivot structure 26*a* on the locating tip 26 of the coupling rod 20 can allow pivoting of the locating tip 26 within the bore 24 of the sleeve 18 when the coupling rod 20 and sleeve 18 are being secured together so that the coupling rod 20 and the sleeve 18 can be secured together in slight axial misalignment. This can allow the stick portions 12 and 14 to be assembled together in axial alignment along the longitudinal axis X of cue stick 10 when one or both of the coupling rod 20 and sleeve 18 are mounted in axial misalignment with their respective stick portions 12 and 14.

Figure 3:
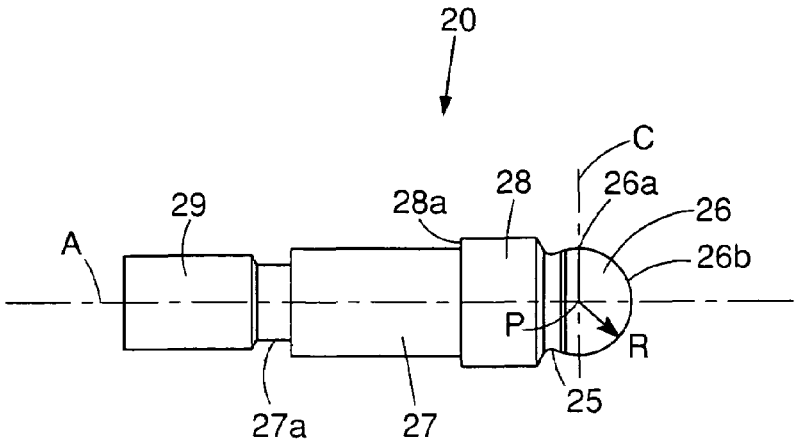
FIG. 3 is a side view of an embodiment of a first joint member or coupling rod.

In one embodiment, referring to FIG. 3, the locating tip 26 of the coupling rod 20 can be located at the distal end of coupling rod 20 and extend along the longitudinal axis A of the coupling rod 20. The locating tip 26 can have a generally spherical portion 26*b* that extends from the male threaded region 28 and can be connected to the male threaded region 28 by a neck 25. As a result, the generally spherical portion 26*b* can be a partial sphere, for example, about ¾ of a sphere, depending upon the diameter of the neck 25.

The pivot structure 26*a* can include the rounded or curved surfaces of the generally spherical portion 26*b* which allow the locating tip 26 and the coupling rod 20 to pivot about a pivot point center P. These rounded or curved surfaces can be on and near the lateral axis C of coupling rod 20 which passes through the pivot point P perpendicular to the longitudinal axis A of the coupling rod 20. The spherical portion 26*b* can have a radius R extending or centered from pivot point P. Since the generally spherical portion 26*b* can have a constant radius R at regions on and near the lateral axis C, the engagement diameter of the pivot structure 26*a* with the bore 24 of the sleeve 18 can remain constant with pivoting of the locating tip 26. The engagement of the pivot structure 26*a* with the bore 24 can be a narrow annular band or line of contact or engagement. The actual location of the annular contact or engagement on the generally spherical portion 26*b* can change with pivoting. The curved surface of the generally spherical portion 26*b* at the pivot structure 26*a* can promote and allow pivoting or rotation of the locating tip 26 within and against the bore 24.

The male threaded region 28 can have a thread pitch and length sufficient to provide engagement with the female threaded region 22 of the sleeve 18 in about one turn or revolution. In some embodiments, engagement can occur in multiple revolutions, for example, about 7 revolutions. A typical number of multiple turns can be about 2-4 turns. Although 4 or less turns is desirable, various numbers of turns can be used, depending upon the situation at hand.

A smooth outer diameter portion or region 27 with a constant diameter can be connected and adjacent to male threaded region 28 for centering the coupling rod 20 within bushing 15. A secondary male threaded region 29 can extend from the smooth outer diameter region 27 and can be separated from the smooth outer diameter region 27 by a neck 27*a*. The smooth outer diameter region 27 can have spiraling glue groove on the outer surface.

In one embodiment, the coupling rod 20 can be formed of metal, such as steel, but can be formed of other suitable methods, such as polymers and composites. The coupling rod can be about 1.5 inches long. The generally spherical portion 26*b* of the locating tip 26 can have a diameter of about 0.32 inches (radius R of 0.16 inches) and can extend about 0.32 inches from the male threaded region 28. The male threaded region 28 can have a ⅜-11 thread, with truncated threads about 0.18 to 0.22 inches long. The smooth outer diameter portion 27, and can be about 0.31 inches in diameter and about 0.5 inches long. The secondary threaded region 29 can be a 5/16-14 thread and extend from the smooth outer diameter region 27 about 0.5 inches.

In order to position the collar 30 about coupling rod 20, the smooth outer diameter region 27 of coupling rod 20 can be first inserted into a hole 15*c* within bushing 15 until the shoulder 28*a* of male threaded region 28 engages the outer face of the bushing 15 and is secured therein (FIG. 2). The bushing 15 can then be inserted and secured within cavity 9 in the collar 30 for concentrically and axially positioning the collar 30 around the male threaded region 28. The bushing 15 can have at first portion 15*a* for engaging bore portion 9*a* of the cavity 9, and a flange 15*b* for engaging shoulder 9*b*. This can position collar 30 relative to coupling rod 20 to form an annular recess 31 surrounding the male threaded region 28 of the coupling rod 20. The coupling rod 20, bushing 15 and collar 30 can be preassembled as a coupling rod/collar assembly. When the secondary male threaded region 29 of the coupling rod 20 is engaged within hole 12*a* of the stick portion 12, the shoulder 28*a* can tighten the bushing 15 and collar 30 against the end 12*b* of stick portion 12. Consequently, when the stick portions 12 and 14 of cue stick 10 are assembled during use, the face 30*a* of the collar 30 can engage and become tightened against the face 14*a* of stick portion 14. In some embodiments, the smooth outer diameter region 27 can be mounted within a hole in the stick portion 12. In some instances, the collar 30 can be omitted.

Figure 4:
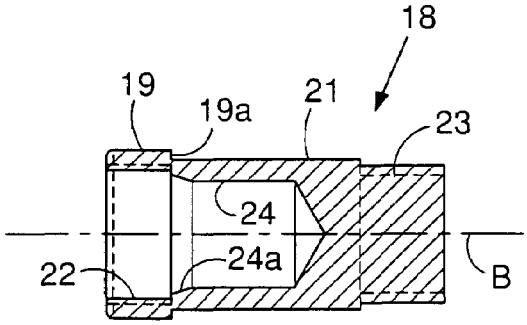
FIG. 4 is a side sectional view of an embodiment of a second joint member or sleeve.

In one embodiment, referring to FIG. 4, the sleeve 18 can have a female threaded region 22 having a length extending along the longitudinal axis B of the sleeve 18 which generally corresponds to the length of the male threaded region 28 of the coupling rod 20. The major, minor, and/or pitch diameters of the female threaded region 22 can be formed with enough clearance relative to the male threaded region 28 of the coupling rod 20 so that the male threaded region 28 can move slightly laterally or perpendicular to relative to the longitudinal axis B of the sleeve 18. The bore 24 can have a tapered entrance 24*a* transitioning from the female threaded region 22. The bore 24 can have a smooth constant inner diameter portion and can be sized to have a close fit with the locating tip 26 of the coupling rod 20. A smooth outer diameter portion or region 21 can engage hole 13 for centering the sleeve 18 within stick portion 14. The secondary male threaded portion or region 23 can extend from the smooth outer diameter region 21 for engaging the bottom portion or region 11 of the hole 13 to secure the sleeve 18 within hole 13. The sleeve 18 can have a head 19 with a shoulder 19*a* which can engage the face 14*a* of stick portion 14 so that the head 19 can protrude from the face 14*a*. The female threaded region 22 can be positioned within the head 19. As a result, the head 19 can be inserted into the recess 31 between collar 30 and the male threaded region 28 of the coupling rod 20 so that the threaded regions 28 and 22 can engage each other.

In one embodiment, the sleeve 18 can be made of a metal, such as brass or bronze. Alternatively, the sleeve can be made of other suitable materials, such as polymers, composites, etc. The female threaded region 22 can have a ⅜-11 thread, with truncated threads, and can be about 0.16 inches long. The bore 24 can have a diameter of about 0.3215 inches, so that there can be about 0.0015 inches clearance between the locating tip 26 and pivot structure 26*a* of the coupling rod 20 and the bore 24. The secondary male threaded region 23 can have a 7/16-14 thread and can be about 0.25 inches long. The smooth outer diameter portion 21 can have a diameter of about 0.4460 inches, and can include a spiraling glue groove. The head 19 can have an outer diameter of about 0.5 inches.

Figure 5:
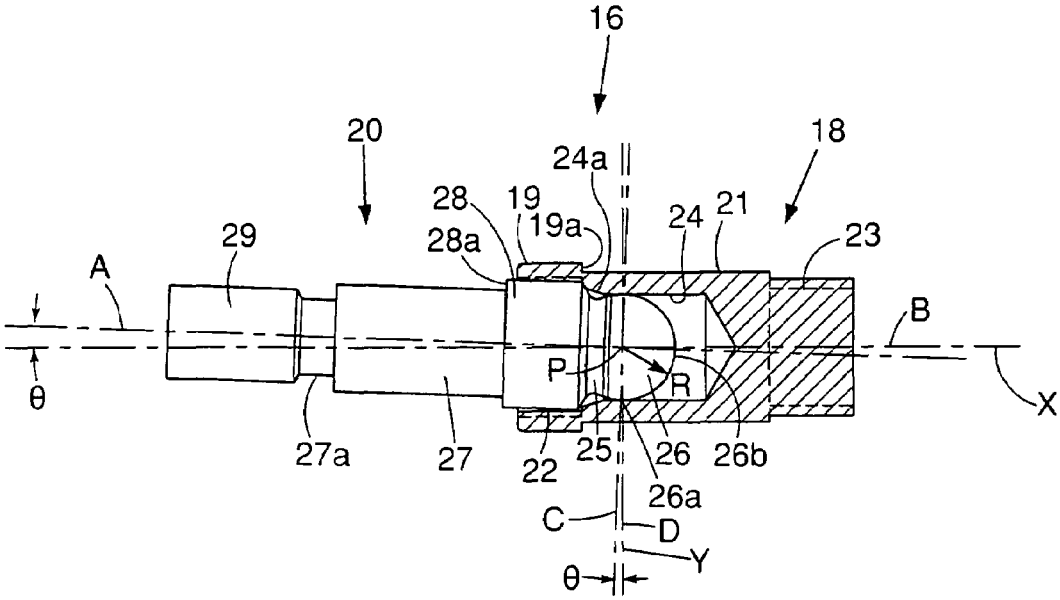
FIG. 5 is a side view of a joint engaged in a manner that can compensate for misalignment.

Typically, when assembled for use, the stick portions 12 and 14 of cue stick 10 are in alignment with each other along the longitudinal axis X. Preferably, the coupling rod 20 and the sleeve 18 are secured to stick portions 12 and 14 in a manner where the axis A of the coupling rod 20 and the axis B of the sleeve 18 are aligned along axis X. However, due to manufacturing methods and tolerances, sometimes the coupling rod 20 and sleeve 18 are secured to stick portions 12 and 14 in a manner where one or both of the axes A and B are misaligned with the axis X of cue stick 10. FIG. 5 depicts an example where the axis A of coupling rod 20 is misaligned with respect to axis X of cue stick 10 and the axis B of sleeve 18 by an angle θ, with the stick portions 12 and 14 being omitted for clarity. Note that the axis B of sleeve 18 is shown to be positioned in alignment with axis Y for simplicity.

The joint 16 can compensate for such misalignment as follows. During assembly of the stick portions 12 and 14, the locating tip 26 and the male threaded region 28 of the coupling rod 20 are inserted into and engage the bore 24 and female threaded region 22 of the sleeve 18. The stick portions 12 and 14 are rotated to tighten the male threaded region 28 within the female threaded region 22. Due to the misalignment, the face 30*a* of the collar on stick portion 12 can be tilted relative to the face 14*a* of the second stick portion 14. As the stick portions 12 and 14 come together, the face 30*a* of the collar 30 on stick portion 12 and the face 14*a* of stick portion 14, can move relative to each other to attempt to have full or flat contact between the faces 30*a* and 14*a*. This can move or push the coupling rod 22 and the sleeve 18 into misalignment to the angle θ as shown in FIG. 5. As the misalignment occurs, the pivot structure 26*a* of the locating tip 26 can pivot or rotate within the bore 24 about pivot point P on the rounded or curved surfaces of pivot structure 26*a* by an amount equal to the angle θ.

The spherical shape of the spherical portion 26*b* at the pivot structure 26*a* can allow the locating tip 26 to pivot or rotate while maintaining annular engagement with the bore 24 along the lateral axis D of sleeve 18. Axis D is shown in FIG. 5 to coincide with lateral axis Y of cue stick 10 which is perpendicular to longitudinal axis X. The spherical portion 26*b* can rotate or roll in place so that the spherical portion 26*b* can simultaneously roll and slide within bore 24, and can form a ball-type joint. In addition, the spherical portion 26*b* can roll as the spherical portion 26*b* moves or slides deeper into the bore 24. As the pivoting occurs, the lateral axis C of the coupling rod 20 that extends through the pivot point P becomes misaligned with the lateral axis D of sleeve 18 by an amount shown by the angle θ. Pivoting of the locating tip 26 within bore 24 can allow pivoting of the coupling rod 20 and sleeve 18 relative to each other such that the axis A of the coupling rod 20 can move to the angle θ relative to the axis B of sleeve 18. The threaded regions 28 and 22 can be provided with sufficient clearance relative to each other to allow such pivoting when engaged. In this manner, the stick portions 12 and 14 of the cue stick 10 can be secured together in axial alignment along axis X in cases where the coupling rod 20 and/or the sleeve 18 are misaligned relative to the axis X of the stick portions 12 and 14.

The compensation for misalignment by joint 16 can allow the stick portions 12 and 14 to be made separately and at different manufacturing locations since tolerances can be increased. As a result, stick portions 12 and 14 can be interchangeable with other stick portions 12 and 14. For example, a user can have one stick portion 12 or 14, and several different stick portions 12 or 14, having different properties, that can be selectively chosen for assembly together, depending upon the situation at hand. Such different properties can include different lengths, stiffness, etc. In addition, if a user damages one stick portion 12 or 14, a replacement stick portion can be purchased without concern that there will be a problem of misalignment of the stick portions when assembled for use.

Figure 6:
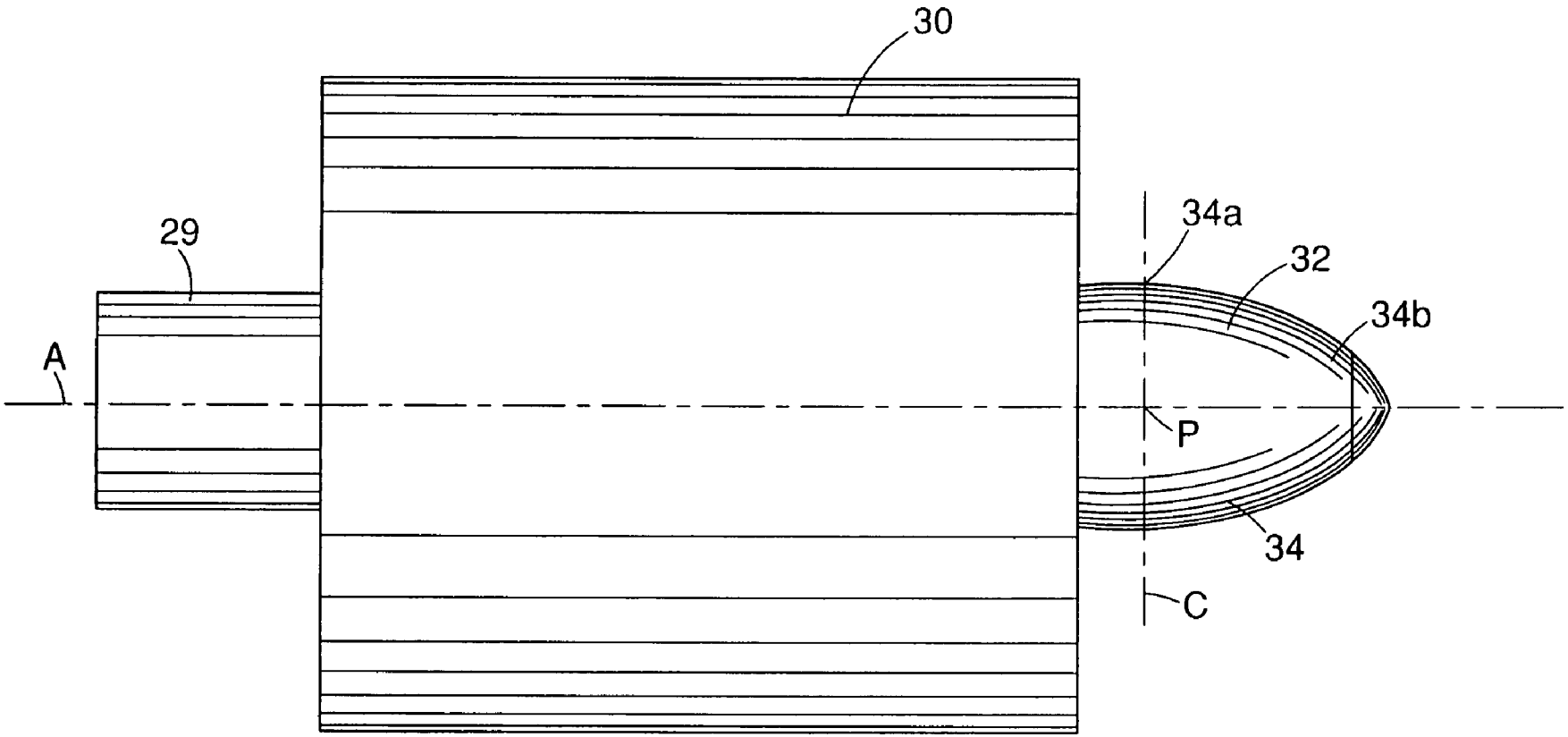
FIG. 6 is a side view of another embodiment of a coupling rod surrounded by a collar in a coupling rod/collar assembly.
Figure 7:
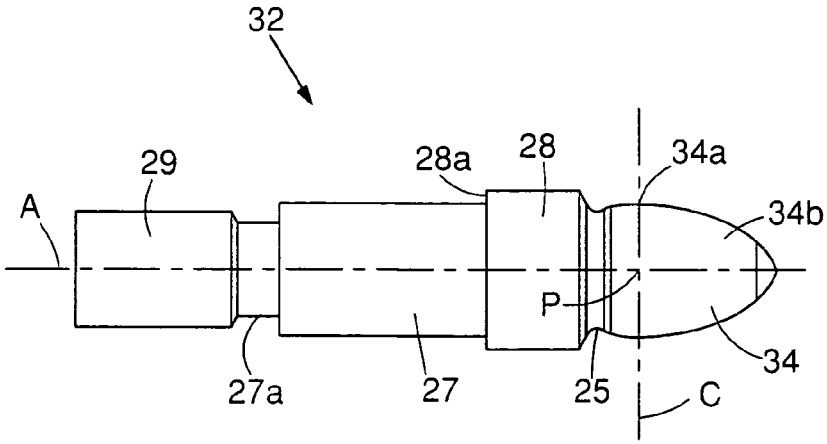
FIG. 7 is a side view of the embodiment of the coupling rod of FIG. 6.

FIGS. 6-12 depict other suitable coupling rods which can be substituted for the coupling rod 20 in joint 16 of the sports stick or cue stick 10. Referring to FIGS. 6 and 7, coupling rod 32 differs from coupling rod 20 in that coupling rod 32 can have a locating tip 34 which has a rounded bullet shaped distal end or tip 34*b*. The locating tip 34 can have a pivot structure 34*a* formed by the curved surfaces in the region on and near axis C. The locating tip 34 and the pivot structure 34*a* can be shaped to provide annular engagement with the bore 24 of sleeve 18 and pivoting, rotating or rolling therein about pivot point P. The locating tip 34 can have a diameter or width at axis C of about 0.32 inches, and the longitudinally curving surfaces of the locating tip 34 can have a radius of about 0.5 inches. The locating tip 34 can extend from the male threaded region about 0.49 inches.

Figure 8:
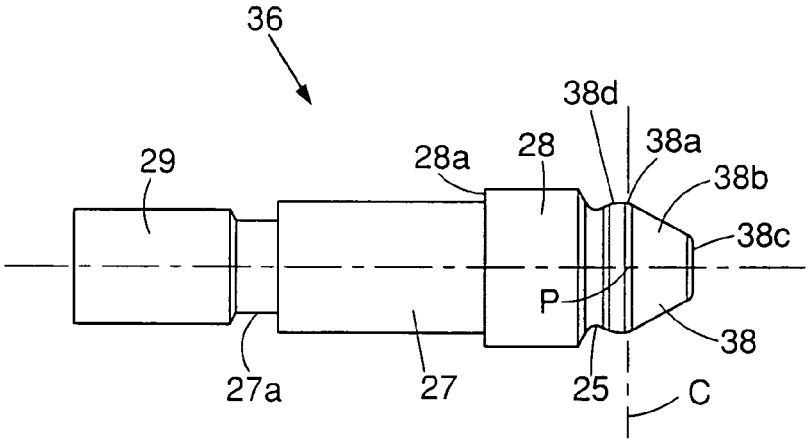
FIGS. 8-12 are side views of other embodiments of coupling rods.

Referring to FIG. 8, coupling rod 36 differs from coupling rod 20 in that the locating tip 38 can have a tapered or angled conical portion 38*b* which terminates in a flat distal end 38*c*. A rounded portion 38*d* can curve into the neck 25. The pivot structure 38*a* can be formed by the narrow transition region between the tapered portion 38*b* and the rounded portion 38*d*. This transition region can be a rounded ridge which can provide annular engagement with the bore 24 of sleeve 18 and pivoting, rotating or rolling therein about pivot point P. The locating tip 38 can have a diameter or width along axis C of about 0.32 inches. The tapered portion 38*b* can be tapered at about a 28° angle and the rounded portion 38*d* can have about a 0.16 inch radius. The locating tip 38 can extend from the male threaded region about 0.28 inches.

Figure 9:
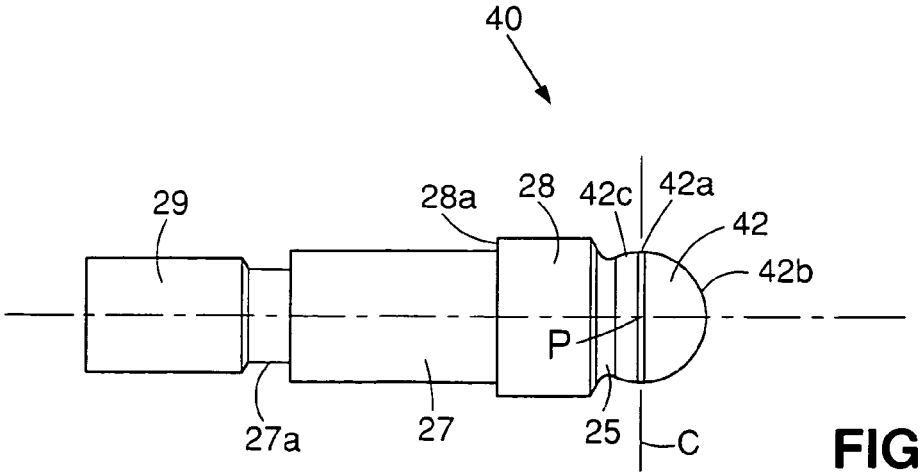

Referring to FIG. 9, coupling rod 40 differs from coupling rod 20 in that the locating tip 42 has a rounded distal end 42*b* which has a larger radius than the radius that is at the pivot structure 42*a* and axis C. The diameter at axis C can be about 0.32 inches (radius of 0.16 inches). The radius of the rounded distal end 42*b* can be about 0.2 inches. There can be a rounded transition portion between the pivot structure 42*a* and the neck 25 which can have a radius of about 0.09 inches. The pivot structure 42*a* can be formed by a narrow rounded ridge region formed by portions 42*b* and 42*c* which can provide annular engagement with the bore 24 of sleeve 18 and pivoting, rotating or rolling therein about pivot point P. The pivot structure 42*a* can have a diameter along axis C of about 0.32 inches (a radius of about 0.16 inches) which can be, for example, about 0.02 inches long. The locating tip 42 can extend from the male threaded region 28 about 0.28 inches.

Figure 10:
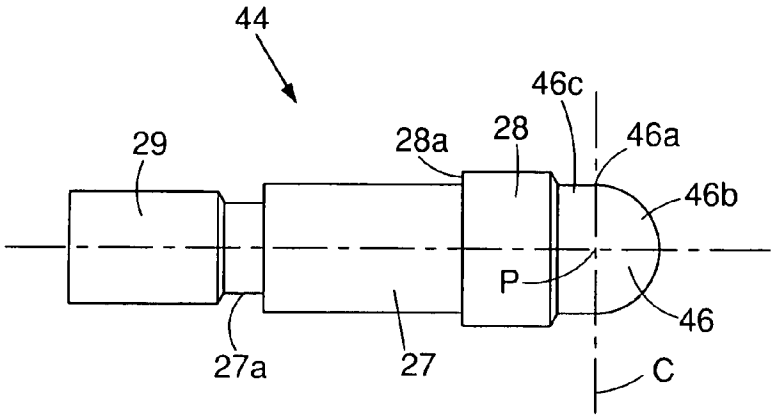

Referring to FIG. 10, coupling rod 44 differs from coupling rod 20 in that locating rip 46 can have a rounded distal end portion 46*b* which can be extended from, connected to or transition to a constant diameter portion 46*c* at axis C. The pivot structure 46*a* can be located at the transition point of the curved surface which can provide annular engagement with the bore 24 of sleeve 18 and pivoting, rotating or rolling therein about pivot point P. The rounded distal end portion 46*b* can have a radius of about .16 inches (diameter of about .32 inches) at axis C so that the constant diameter portion 46*c* also can have a diameter of about .32 inches. The length of the constant diameter portion 46*c* can be sized so that the pivot structure 46*a* engages the bore 24 of sleeve 18 just beyond the tapered entrance 24*a*,thereby allowing pivoting. The constant diameter portion 46*c* can be about 0.1 inches long.

Figure 11:
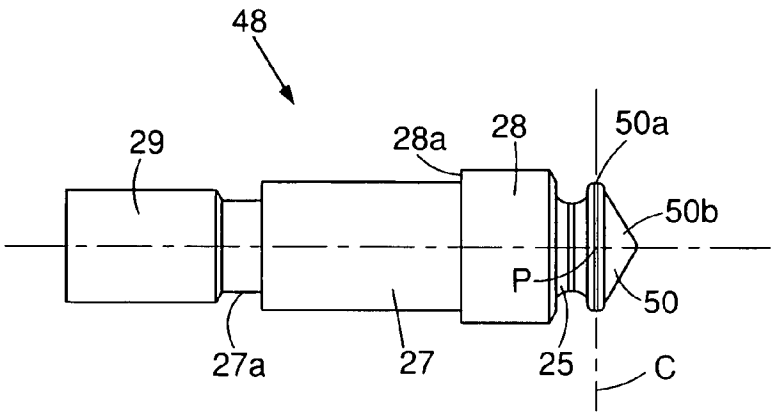

Referring to FIG. 11, coupling rod 48 differs from coupling rod 36 in that locating tip 50 can have a distal end 50*b* that tapers or angles to a conical point. The pivot structure 50*a* can be at the beginning or outer diameter of the taper and can be on a ridge centered about axis C. The ridge of the pivot structure 50*a* can be rounded which can provide annular engagement with the bore 24 of sleeve 18 and pivoting, rotating or rolling therein about pivot point P. The diameter of the pivot structure 50*a* at axis C can be about 0.32 inches and can have about a 0.02 inch radius curve on the edges of the ridge. The locating tip 50 can extend from the male threaded region 28 about 0.21 inches.

Figure 12:
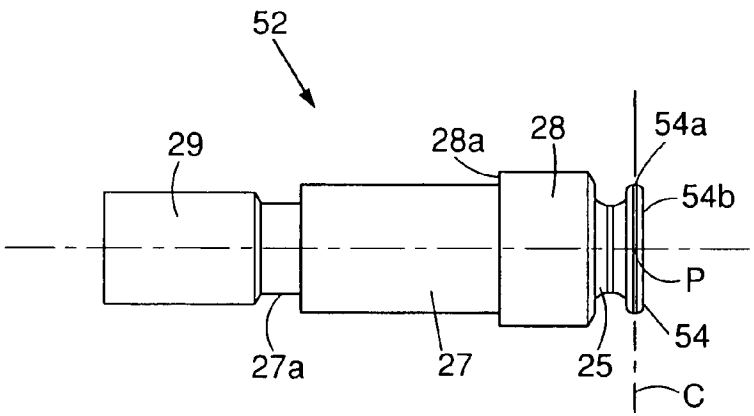

Referring to FIG. 12, coupling rod 52 differs from coupling rod 48 in that locating tip 54 can have a flat distal end 54*b*. As a result, locating tip 54 can be considered a narrow disc that extends from and can be connected to the male threaded region 28 by neck 25. The disc can form the pivot structure 54*a* and can have a rounded ridge with rounded edge surfaces to promote or allow pivoting, rotating or rolling within the bore 24 of sleeve 18 about pivot point P while providing annular engagement. The pivot structure 54*a* can be about 0.32 inches in diameter at axis C for a length of about 0.01 inches, and can have thickness of about 0.04 inches.

Figure 13:
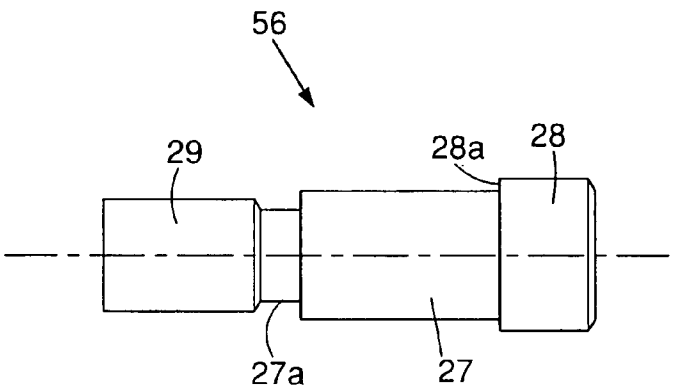
FIG. 13 is a side view of yet another embodiment of a coupling rod.

FIG. 13 depicts a coupling rod 56 which differs from coupling rod 20 in that there is no locating tip. The male threaded region 28 can engage the female threaded region 22 of sleeve 18 and the threaded regions 28 and 22 can be formed with enough clearance between the threads to allow slight lateral movement of the male threaded region 28 within the female threaded region 22 so that the stick portions 12 and 14 can tighten together in alignment if there is misalignment of the coupling rod 56 and sleeve 18.

While this invention has been particularly shown and described with references to particular embodiments thereof, it will be understood by those skilled in the art that various changes in form and details may be made therein without departing from the scope of the invention encompassed by the appended claims.

For example, it is understood that although particular examples of dimensions have been described, it is understood that dimensions can vary depending upon the situation at hand. In addition, the locating tips can be made to be resilient, so that bending or deflection of the locating tip can compensate for misalignment. Various features can be combined or omitted. The joint in the present invention can be used in other sports sticks that can be assembled from multiple pieces including golf clubs. Other embodiments of the joint in the present invention can include applications such as tent poles, sticks for paint rollers, etc. It is understood that a stick in the present invention can have more than two stick portions that can be assembled together.

What is claimed is:

1. A joint for a cue stick, the cue stick having first and second cue stick portions, the joint comprising:

a first joint member having a central longitudinal axis for securing to the first stick portion, the first joint member including a joint securing male threaded region and a locating tip at a distal end; and a second joint member for securing to the second stick portion, the second joint member having a bore for receiving the locating tip, and a joint securing female threaded region for engaging the joint securing male threaded region of the first joint member for coupling the first and second joint members together, the bore having a constant inner diameter portion, the locating tip comprising a generally disc shaped portion at the distal end having a pivot structure shaped with a longitudinally varied pivot surface and having a pivot point center positioned on the longitudinal axis, the pivot point center having a lateral axis perpendicular to the longitudinal axis extending through the longitudinally varied pivot surface of the pivot structure, the pivot structure configured and positioned to engage the constant inner diameter portion of the bore and pivot within and against the constant inner diameter portion of the bore such that the first joint member is capable of pivoting about the pivot point center of the pivot structure when the joint securing threaded regions of the first and second joint members are engaged to compensate for misalignment of the first and second joint members.

2. The joint of claim 1 in which the pivot structure of the locating tip has a close fit with the bore.

3. The joint of claim 2 in which the pivot structure of the locating tip has a narrow annular region of engagement with the bore within the constant diameter portion.

4. The joint of claim 1 in which the first and second joint members are capable of engaging together within about four turns relative to each other.

5. The joint of claim 4 in which the first and second joint members are capable of engaging together within about one turn relative to each other.

6. The joint of claim 1 in which the first joint member further includes a collar encircling the male threaded region.

7. The joint of claim 1 in which the first and second joint members include secondary male threaded regions for securing the first and second joint members to respective first and second stick portions.

8. The joint of claim 7 in which the first and second joint members each include a smooth outer diameter region adjacent to the secondary male threaded region.

9. A cue stick comprising:

a first cue stick portion;

a first joint member having a central longitudinal axis secured to the first stick portion, the first joint member including a joint securing male threaded region and a locating tip at a distal end;

a second cue stick portion; and a second joint member secured to the second stick portion, the second joint member having a bore for receiving the locating tip, and a joint securing female threaded region for engaging the joint securing male threaded region of the first joint member for coupling the first and second joint members together, the bore having a constant inner diameter portion, the locating tip comprising a generally disc shaped portion at the distal end having a pivot structure shaped with a longitudinally varied pivot surface and having a pivot point center positioned on the longitudinal axis, the pivot point center having a lateral axis perpendicular to the longitudinal axis extending through the longitudinally varied pivot surface of the pivot structure, the pivot structure configured and positioned to engage the constant inner diameter portion of the bore and pivot within and against the constant inner diameter portion of the bore such that the first joint member is capable of pivoting about the pivot point center of the pivot structure when the joint securing threaded regions of the first and second joint members are engaged to compensate for misalignment of the first and second joint members.

10. The cue stick of claim 9 in which the pivot structure of the locating tip has a close fit with the bore.

11. The cue stick of claim 10 in which the pivot structure of the locating tip has a narrow annular region of engagement with the bore within the constant diameter portion.

12. The cue stick of claim 9 in which the first and second stick portions are capable of engaging together within about four turns relative to each other.

13. The cue stick of claim 12 in which the first and second stick portions are capable of engaging together within about one turn relative to each other.

14. The cue stick of claim 9 in which the first joint member further includes a collar encircling the male threaded region.

15. The cue stick of claim 9 in which the first and second joint members include secondary male threaded regions for securing the first and second joint members to respective first and second stick portions.

16. The cue stick of claim 15 in which the first and second joint members each include a smooth outer diameter region adjacent to the secondary male threaded region.

17. A joint for a sports stick, the sports stick having first and second sports stick portions, the joint comprising:

a first joint member having a central longitudinal axis for securing to the first stick portion, the first joint member including a joint securing male threaded region and a locating tip at a distal end; and a second joint member for securing to the second stick portion, the second joint member having a bore for receiving the locating tip, and a joint securing female threaded region for engaging the joint securing male threaded region of the first joint member for coupling the first and second joint members together, the bore having a constant inner diameter portion, the locating tip comprising a generally disc shaped portion at the distal end having a pivot structure shaped with a longitudinally varied pivot surface and having a pivot point center positioned on the longitudinal axis, the pivot point center having a lateral axis perpendicular to the longitudinal axis extending through the longitudinally varied pivot surface of the pivot structure, the pivot structure configured and positioned to engage the constant inner diameter portion of the bore and pivot within and against the constant inner diameter portion of the bore such that the first joint member is capable of pivoting about the pivot point center of the pivot structure when the joint securing threaded regions of the first and second joint members are engaged to compensate for misalignment of the first and second joint members.

18. A sports stick comprising:

a first sports stick portion;

a first joint member having a central longitudinal axis secured to the first stick portion, the first joint member including a joint securing male threaded region and a locating tip at a distal end;

a second sports stick portion; and a second joint member secured to the second stick portion, the second joint member having a bore for receiving the locating tip, and a joint securing female threaded region for engaging the joint securing male threaded region of the first joint member for coupling the first and second joint members together, the bore having a constant inner diameter portion, the locating tip comprising a generally disc shaped portion at the distal end having a pivot structure shaped with a longitudinally varied pivot surface and having a pivot point center positioned on the longitudinal axis, the pivot point center having a lateral axis perpendicular to the longitudinal axis extending through the longitudinally varied pivot surface of the pivot structure, the pivot structure configured and positioned to engage the constant inner diameter portion of the bore and pivot within and against the constant inner diameter portion of the bore such that the first joint member is capable of pivoting about the pivot point center of the pivot structure when the joint securing threaded regions of the first and second joint members are engaged to compensate for misalignment of the first and second joint members.

19. A joint for a cue stick, the cue stick having first and second cue stick portions, the joint comprising:

first joint member means having a central longitudinal axis for securing to the first stick portion, the first joint member means including a joint securing male threaded region and a locating tip at a distal end; and second joint member means for securing to the second stick portion, the second joint member means having a bore for receiving the locating tip, and a joint securing female threaded region for engaging the joint securing male threaded region of the first joint member means for coupling the first and second joint member means together, the bore having a constant inner diameter portion, the locating tip comprising a generally disc shaped portion at the distal end having pivot structure means shaped with a longitudinally varied pivot surface and having a pivot point center positioned on the longitudinal axis, the pivot point center having a lateral axis perpendicular to the longitudinal axis extending through the longitudinally varied pivot surface of the pivot structure means, the pivot structure means configured and positioned for engaging the constant inner diameter portion of the bore and pivoting within and against the constant inner diameter portion of the bore such that the first joint member means is capable of pivoting about the pivot point center of the pivot structure means when the joint securing threaded regions of the first and second joint member means are engaged to compensate for misalignment of the first and second joint member means.

* * * * *